US006135738A

United States Patent [19]

Kajiwara et al.

[11] Patent Number: 6,135,738

[45] Date of Patent: Oct. 24, 2000

[54] SCROLL COMPRESSOR HAVING A DISCHARGE PORT IN THE MOVEABLE SCROLL

[75] Inventors: Mikio Kajiwara; Yoshitaka Shibamoto; Keiji Yoshimura, all of Osaka, Japan

[73] Assignee: Daikin Industries, Ltd., Osaka, Japan

[21] Appl. No.: 09/011,907

[22] PCT Filed: Jun. 13, 1997

[86] PCT No.: PCT/JP97/02066

§ 371 Date: Feb. 23, 1998

§ 102(e) Date: Feb. 23, 1998

[87] PCT Pub. No.: WO97/49918

PCT Pub. Date: Dec. 31, 1997

[30] Foreign Application Priority Data

Jun. 24, 1996 [JP] Japan ..... 8-163023

[51] Int. Cl.[7] ..... F04C 18/04; F04C 29/02

[52] U.S. Cl. ..... 418/55.4; 418/55.6; 418/88; 418/94; 418/188; 418/DIG. 1

[58] Field of Search ..... 418/55.1, 55.4, 418/55.6, 88, 94, 188, DIG. 1

[56] References Cited

U.S. PATENT DOCUMENTS

| | | | |
|---|---|---|---|
| 4,928,503 | 5/1990 | Riffe | 418/55.6 |
| 5,040,952 | 8/1991 | Inoue et al. | 418/55.1 |
| 5,224,848 | 7/1993 | Noburu et al. | 418/188 |

FOREIGN PATENT DOCUMENTS

| | | |
|---|---|---|
| 0 480 065 | 4/1992 | European Pat. Off. . |
| 0 698 736 | 2/1996 | European Pat. Off. . |
| 1-178785 | 7/1989 | Japan . |
| 3-237287 | 10/1991 | Japan . |
| 4-272401 | 9/1992 | Japan . |
| 5-1682 | 1/1993 | Japan . |
| 9-088862 | 3/1997 | Japan . |
| 93/17241 | 9/1993 | WIPO . |

*Primary Examiner*—John J. Vrablik

*Attorney, Agent, or Firm*—Nixon Peabody; Donald R. Studebaker

[57] ABSTRACT

In a scroll compressor (A) configured such that an oil is supplied to a compression chamber (14) between fixed and movable scrolls (10), (11) and to bearings (28), (29) for a crank shaft (8), an electric motor (7) and an oil reservoir 1*a* are placed in a discharge chamber (22), a discharge port (11*c*) for discharging a gas compressed in the compression chamber (14) is formed in an end plate (11*a*) of the movable scroll (11), and the crank shaft (8) is provided at the inside thereof with a discharge gas passage (8*e*) for causing the gas discharged through the discharge port (11*c*) of the movable scroll (11) to flowinto the discharge chamber (22). The sucked gas is prevented from being heated by a heat loss of the electric motor (7) or the oil thereby increasing the performance of the compressor (A) and a rise in cost for separating the oil from the compressed gas can be prevented.

4 Claims, 1 Drawing Sheet

SCROLL COMPRESSOR HAVING A DISCHARGE PORT IN THE MOVEABLE SCROLL

TECHNICAL FIELD

This invention relates to a scroll compressor and particularly relates to techniques for supplying an oil to a compression chamber in a compression mechanism of the compressor to keep the compression chamber gastight.

BACKGROUND ART

Such a scroll compressor includes, in a sealed casing, a scroll compression mechanism composed of: a fixed scroll fixed on the casing; and a movable scroll which is driven into travel around the axis of the fixed scroll through a crank shaft by a drive means such as a motor. The fixed scroll is formed such that a volute projects from an end plate. The movable scroll has an end plate opposed to the end plate of the fixed scroll. From the end plate of the movable scroll, a volute projects so as to divide a compression chamber into sections by the engagement with the volute of the fixed scroll. Through the travel of the movable scroll, a gas sucked from the outer peripheries of the volutes of both the scrolls is compressed in the compression chamber.

In the above scroll compressor, from a performance viewpoint, the compression chamber must be kept gastight. Therefore, it is required to eliminate gaps between the end surface of the volute of each scroll and the end plate of the opposite scroll. To satisfy the requirement, there is proposed a conventional technique as disclosed in Japanese Patent Application Laid-Open Gazette No. 3-237287, in which an oil is pumped from an oil reservoir located at a lower part inside of the casing by a supply pump driven by a crank shaft, the oil is supplied to a space between the volutes of both the scrolls through a supply passage inside of the crank shaft and the supplied oil fills gaps created between the end surface of each volute and the opposite end plate. In the above proposed technique, a partition wall divides the inner space of the casing into two chambers, i.e., a discharge chamber filled with a gas discharged from the scroll compression mechanism and a suction chamber filled with a gas sucked into the compression mechanism. The motor and the oil reservoir are placed in the suction chamber.

In the proposed technique, however, the oil having a low pressure is supplied, together with the sucked gas, from the outer peripheries of the volutes of both the scrolls to the compression chamber, which causes the oil to apply heat to the sucked gas. Further, the gas in the suction chamber is heated also by a heat loss of the motor, which decreases a compressor performance.

Furthermore, the proposed technique requires an oil separation mechanism such as a demister for separating the oil mixed with the gas during compression in the compression chamber from the discharged gas and an oil backing mechanism such as a capillary for returning the separated oil to the oil reservoir located on a lower-pressure side in the casing. This invites a rise in cost.

There is also known a conventional technique in which an oil pumped from an oil reservoir by a supply pump is supplied to a bearing for a crank shaft through a supply passage inside of the crack shaft so that the bearing is lubricated by the supplied oil. Also in this case that the oil is supplied to the bearing for the crank shaft, the low-pressure oil is mixed with a sucked gas in a lower-pressure chamber. Accordingly, the present case has the same problem as in the first-described case.

An object of the present invention is to prevent a sucked gas from being heated by a heat loss of a motor or an oil when the oil is supplied for increasing the gas-tightness of a compression chamber or for lubricating a bearing for a crank shaft, thereby increasing a compressor performance and to eliminate a special member for separating the oil from a compressed gas thereby preventing a rise in cost.

DISCLOSURE OF INVENTION

To attain the above object, in the present invention, drive means and an oil reservoir are placed in a discharge chamber. A gas compressed in a compression chamber of a scroll compression mechanism is discharged from a movable scroll side and is caused to flow into a discharge chamber through the inside of a crank shaft for driving the movable scroll.

More specifically, the present invention premises a scroll compressor having a partition wall (25) which is disposed in a sealed casing (1) and divides an inner space of the sealed casing (1) into a discharge chamber (22) and a suction chamber (23). Further, the scroll compressor comprises: a scroll compression mechanism (3) which is composed of a fixed scroll (10) and a movable scroll (11) each disposed in the casing (1), the fixed scroll (10) being composed of an end plate **(10*a*) and a volute (10*b*) projecting from the end plate (10*a*), the movable scroll (11) being composed of an end plate (11*a*) and a volute (11*b*) which projects from the end plate (11*a*) and is engaged with the volute (10*b*) of the fixed scroll (10) to divide a compression chamber (14) into sections, the scroll compression mechanism (3) compressing in the compression chamber (14) a gas sucked from the outer peripheries of the volutes (10*b*), (11*b*) of both the scrolls (10), (11) through the travel of the movable scroll (11) around the axis of the fixed scroll (10) and then discharging the gas to the discharge chamber (22); drive means (7) for driving the movable scroll (11) through a crank shaft (8) into travel around the axis of the fixed scroll (10); and a supply pump (8*a*) for sucking an oil of an oil reservoir (1*a*) in the casing (1) and supplying the sucked oil to a bearing (28), (29) for the crank shaft (8) through a supply passage (8*b*) provided in the crank shaft (8)**.

Furthermore, the drive means (7) and the oil reservoir **(1*a*) are placed in the discharge chamber (22). A discharge port (11*c*) for discharging the gas compressed in the compression chamber (14) is formed in the end plate (11*a*) of the movable scroll (11). In addition, the crank shaft (8) is provided at the inside thereof with a discharge gas passage (8*e*) for causing the gas discharged through the discharge port (11*c*) of the movable scroll (11) to flow into the discharge chamber (22)**.

According to the above structure, since the drive means (7) and the oil reservoir **(1*a*) are placed in the high-pressure discharge chamber (22), a sucked gas in the suction chamber (23) is prevented from being heated by an oil supplied to the bearing (28), (29) for the crank shaft (8) or a heat loss of the drive means (7) such as an electric motor. Also when the oil in the oil reservoir (1*a*) is supplied to the compression chamber (14), the high-pressure oil is supplied in the middle of compression of a gas by the use of a pressure difference between the inside and outside of the scroll compression mechanism (3), which prevents the sucked gas from being heated by the oil. In addition, the oil supplied to the compression chamber (14) keeps the compression chamber (14)** gastight.

The high-pressure gas compressed in the compression chamber (14) is discharged, in a state mixed with the oil supplied to the compression chamber (14) and the oil supplied to the bearing (28), (29) for the crank shaft (8), through the discharge port (11*c*) of the movable scroll (11), and is then caused to flow into the discharge chamber (22) through the discharge gas passage (8*e*) inside of the crank shaft (8). Thereby, an oil is separated from the discharged gas in the discharge gas passage (8*e*) of the crank shaft (8) in rotation and is returned from the discharge gas passage (8*e*) to the oil reservoir (1*e*). On the other hand, though the discharge chamber (22) provided with the drive means (7) is filled with the discharged gas, the discharged gas includes no oil, which prevents an oil discharge through the drive means (7). Accordingly, a compressor performance can be increased, and an oil can be separated efficiently at the inside of the crank shaft without the necessity for a special member such as a demister and a capillary thereby suppressing a rise in cost for separating the oil from the discharged gas.

The scroll compression mechanism (3) may be placed in the suction chamber (23). In this structure, since the scroll compression mechanism (3) is not affected by a heat loss of the drive means (7), it is prevented that the heat loss is transmitted to the compression chamber (14) in the compression mechanism (3) to heat a sucked gas. Accordingly, a compressor performance can be securely increased.

There may be a structure that the downstream end of the discharge gas passage (8*e*) in the crank shaft (8) is formed into an opening on the side opposite to the scroll compression mechanism (3) with respect to the drive means (7) and a discharge pipe (6) for discharging the discharge gas flowing into the discharge chamber (22) through the discharge gas passage (8*e*) to the outside of the casing (1) is placed on the same side as the scroll compression mechanism (3) with respect to the drive means (7). Under this structure, the discharged gas flows through the discharge gas passage (8*e*) inside of the crank shaft (8) in the direction opposite to the scroll compression mechanism (3) with respect to the drive means (7), flows from the opening at the downstream end of the discharge gas passage (8*e*) into the discharge chamber (22), and is then discharged from the discharge pipe (6) on the same side as the scroll compression mechanism (3) with respect to the drive means (7) to the outside of the casing (1). Thus, the discharged gas separated from an oil in the crank shaft (8) is sure to flow around the drive means (7) toward the discharge pipe (6). Accordingly, it is possible to cool the drive means (7) efficiently while preventing an oil discharge through the drive means (7).

Further, an oil separation mechanism (37) may be placed in the discharge chamber (22) between the drive means (7) and the opening at the downstream end of the discharge gas passage (8*e*). Under this structure, in such a case that the drive means (7) is variable in speed by an inverter or the like and a large amount of oil is supplied to the compression chamber (14) under high-speed rotation of the drive means (7) so that the discharged gas includes a large amount of oil, an oil which has not been separated from the gas in the discharge gas passage (8*e*) of the crank shaft (8) can be surely separated by the oil separation mechanism (37), thereby securely preventing an oil discharge through the drive means (7). In addition, a large space can be generally created on the side opposite to the scroll compression mechanism (3) with respect to the drive means (7), which increases an oil separation efficiency of the oil separation mechanism (37). As a result, an oil discharge through the drive means (7) can be securely prevented.

Furthermore, between the discharge port (11*c*) of the movable scroll (11) and an opening at the upstream end of the discharge gas passage (8*e*), there may be provided a sealing member (26) for keeping the gas discharged through the discharge port (11*c*) away from the oil pumped through the supply passage (8*b*) by the supply pump (8*a*). Under this structure, the sealing member (26) prevents the gas discharged through the discharge port (11*c*) from being mixed with the oil pumped through the supply passage (8*b*) by the supply pump (8*a*), so that the discharged gas can be securely introduced into the discharge gas passage (8*e*). This realizes further effective prevention of oil discharge through the drive means (7).

BEST MODE FOR CARRYING OUT THE INVENTION

Figure 1:
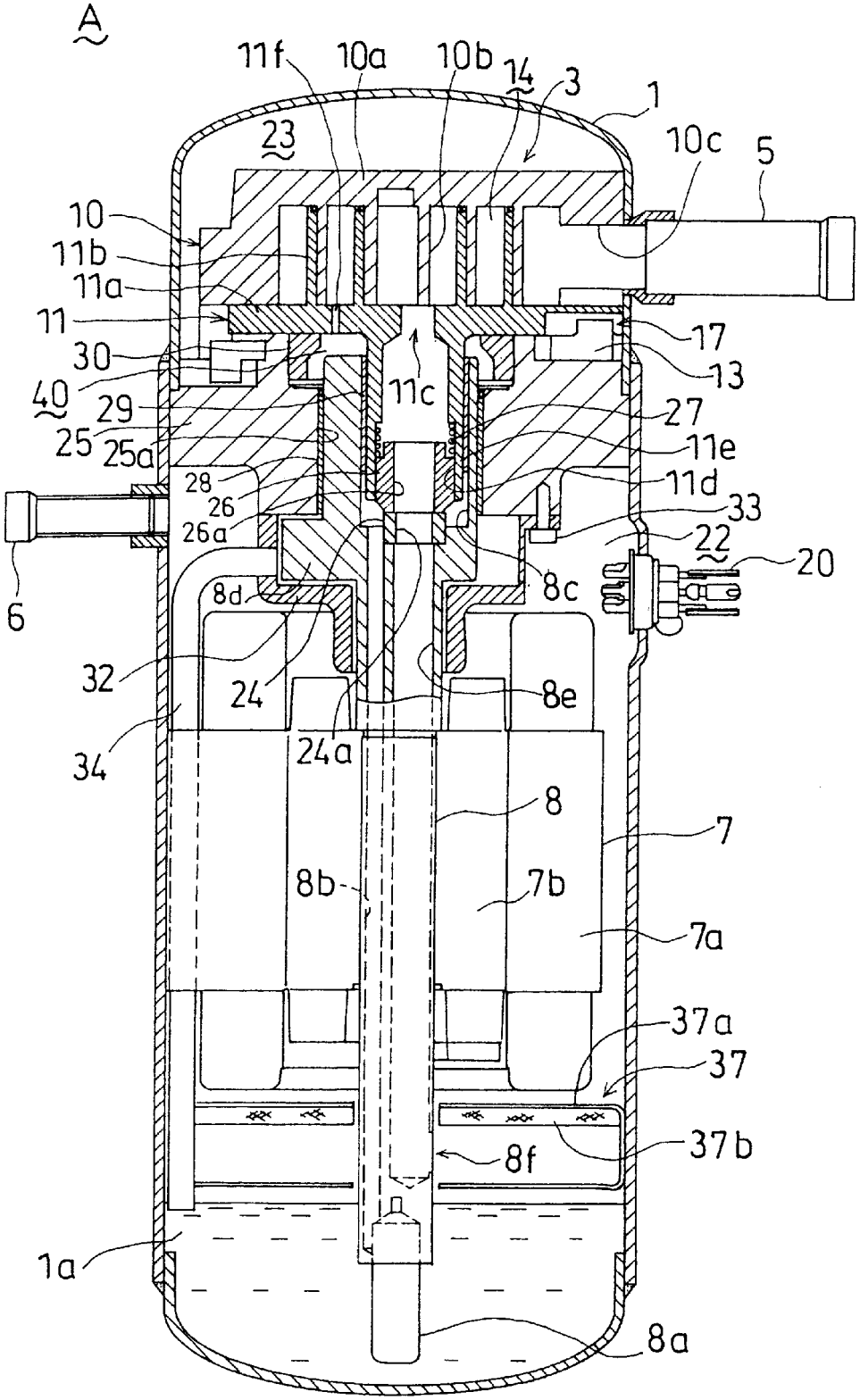
FIG. 1 is a cross section showing a scroll compressor according to an embodiment of the present invention.

Best mode for carrying out the present invention will be described as an embodiment of the invention with reference to the drawings.

FIG. 1 shows a scroll compressor (A) as an embodiment of the present invention. The scroll compressor (A) has a sealed casing (1). At an upper part in the casing (1), there is disposed a partition wall (25) for hermetically dividing an inner space of the casing (1) into a discharge chamber (22) located at a lower position and a suction chamber (23) located at an upper position. The partition wall (25) is fixedly attached to the inner periphery of the side wall of the casing (1). In the suction chamber (23), a scroll compression mechanism (3) for sucking a gas refrigerant and compressing it is housed. At an upper part in the discharge chamber (22), an electric motor (7) as a drive means for driving the scroll compression mechanism (3) is housed. At a lower part in the discharge chamber (22), an oil reservoir (1*a*) for storing a lubricating oil is provided. The oil reservoir (1*a*) is placed on the side opposite to the scroll compression mechanism (3) with respect to the electric motor (7).

A discharge pipe (6) hermetically passes through the side wall of the casing (1) located on the same side as the scroll compression mechanism (3) with respect to the electric motor (7) at the upper part in the discharge chamber (22) and is fixed to the casing side wall. The gas refrigerant compressed by the scroll compression mechanism (3) flows through the discharge pipe (6) from the discharge chamber (22) and is discharged to the outside of the compressor (A). Further, a suction pipe (5) hermetically passes through the side wall of the casing (1) located at the side of the suction chamber (23) and is fixed to the casing side wall. The gas refrigerant is sucked into the scroll compression mechanism (3) through the suction pipe (5).

The electric motor (7) includes a stator (7*a*) and a rotor (7*b*) rotatably provided in the stator (7*a*). A crank shaft (8) is press-fitted in a central through hole of the rotor (7*b*) so as to come through the through hole. Thereby, the crank shaft (8) is fixed to the rotor (7*b*) so that they can integrally rotate.

A centrifugal supply pump (8*a*) is fixedly attached to the lower end of the crank shaft (8) and is immersed in a lubricating oil stored in the oil reservoir (1*a*). At the inside of the crank shaft (8), a supply passage (8*b*) is formed so as to extend in an axial direction for supplying the lubricating oil pumped by the centrifugal supply pump (8*a*) to an upper part of the crank shaft (8).

The scroll compression mechanism (3) is composed of a fixed scroll (10) located at an upper position and a movable scroll (11) located at a lower position. The fixed scroll (10)

is formed such that a volute (10*b*) in involute form projects from the bottom of a disc-like end plate (10*a*). The fixed scroll (10) is fixedly attached to the inner periphery of the side wall of the casing (1).

The movable scroll (11) is formed such that a volute (11*b*) in involute form projects from the top of a disc-like end plate (10*b*) and is engaged with the volute (10*a*) of the fixed scroll (10) to divide a compression chamber (14) into sections. The movable scroll (11) is supported to the top of the partition wall (25) through an Oldham ring (13). The Oldham ring (13) forms a part of an Oldham coupling (17) for preventing the movable scroll (11) from rotating on its axis. The end surface of the volute (11*b*) of the movable scroll (11) contacts the bottom of the end plate (10*a*) of the fixed scroll (10), while the end surface of the volute (10*a*) of the fixed scroll (10) contacts the top of the end plate (11*a*) of the movable scroll (11). Outer and inner peripheries of the volute (11*b*) of the movable scroll (11) come into contact at plural contact points with inner and outer peripheries of the volute (10*b*) of the fixed scroll (10), respectively. The compression chamber (14) for compressing the gas refrigerant is formed among the contact points.

In the side wall of the fixed scroll (10), there is formed a suction port (10*c*) for communicating a space around the outer peripheries of the volutes (10*b*), (11*b*) of the fixed and movable scrolls (10), (11) and the suction pipe (5) to suck a low-pressure gas refrigerant into the compression chamber (14). Further, in the end plate (11*a*) of the movable scroll (11), there is formed, at an approximately central position thereof, a discharge port (11*c*) for discharging a high-pressure gas refrigerant compressed in the compression chamber (14) to a space on the back side of (below) the movable scroll (11).

A boss (11*e*) projects downward from an approximately central position of the bottom of the end plate (11*a*) of the movable scroll (11). In the bottom of the boss (11*e*), there is formed a concavity (11*d*) for connection which is made in an upwardly concave form and is communicated with the discharge port (11*c*). A sealing member (26) having a through hole (26*a*) formed at the center thereof is fitted in a lower part of the concavity (11*d*) for connection so as to be slidable in a vertical direction. The sealing member (26) is pushed downward at all times by a compression spring (27) placed between an upper part of the sealing member (26) and a step formed at an approximately vertical midpoint of the inner surface of the concavity (11*d*) for connection.

The upper end part of the crank shaft (8) is larger in outer diameter than the lower part thereof and is supported to a bearing hole (25*a*) formed in the partition wall (25) through a bearing (28). At the upper end of the crank shaft (8), a concavity (8*c*) is formed at a position decentered from the axis of the crank shaft (8) and fits on the boss (11*e*) of the movable scroll (11) through a bearing (29). The crank shaft (8) is connected at the concavity (8*c*) to the boss (11*e*) of the movable scroll (11) so that they integrally rotate. Accordingly, the Oldham coupling (17) prevents the movable scroll (11) from rotating on the axis of the movable scroll (11) and causes it to travel around the axis of the crank shaft (8) thereby decreasing the compression chamber (14) in volume. A gas refrigerant is sucked into the compression chamber (14) through the suction port (10*c*) of the fixed scroll (10), is compressed in the compression chamber (14) and is then discharged from the discharge port (11*c*). A part of the crank shaft (8) located immediately below the partition wall (25) projects in the direction opposite to a decentered direction of the sealing member (26) to form a balance weight (8*d*) for canceling a centrifugal force generated in the movable scroll (11).

On the bottom of the concavity (8*c*) of the crank shaft (8), a bushing (24) having a through hole (24*a*) formed at the center thereof is fixed by press fit. The sealing member (26) is pushed downward at all times by the spring (27) so that the bottom surface thereof contacts the top surface of the bushing (24). This allows the bottom surface of the sealing member (26) to rotatively slide on the top surface of the bushing (24) when the crank shaft (8) rotates. Since the sealing member (26) is fitted into the concavity (11*d*) for connection of the boss (11*e*) of the movable scroll (11), this provides a seal between a discharge gas discharged from the discharge port (11*c*) and a lubricating oil pumped up to the bottom of the concavity (8*c*) as mentioned later.

The bushing (24) is placed between the crank shaft (8) and the sealing member (26) in order to increase the slidability between both the members (8), (26), and is provided at the center thereof with the through hole (24*a*) connectedto the throughhole (26*a*) of the sealing member (26).

The supply passage (8*b*) of the crank shaft (8) extends to the bottom of the concavity (8*c*). Thereby, a lubricating oil pumped by the centrifugal supply pump (8*a*) flows into a space (40) between the upper end of the crank shaft (8) and the bottom of the end plate (11*a*) of the movable scroll (11) while lubricating the inner and outer peripheries of the bearing (29) between the boss (11*e*) of the movable scroll (11) and the concavity (8*c*) of the crank shaft (8).

A ring-like sealing member (30) is disposed between the top of the partition wall (25) and the bottom of the end plate (11*a*) of the movable scroll (11) so as to be located on an outer-peripheral side of the bearing hole (25*a*). The sealing member (30) prevents the lubricating oil in the space (40) from leaking into the suction chamber (23). In the end plate (11*a*) of the movable scroll (11), an oil inlet (11*f*) is formed at a position inner than the sealing member (30). A part of the lubricating oil pumped up to the space (40) is supplied to the compression chamber (14) of the scroll compression mechanism (3) through the oil inlet (11*f*). Specifically, a high-pressure lubricating oil is supplied to the compression chamber (14) by the use of a pressure difference between the inside and outside of the scroll compression mechanism (3) in the middle of compression of a gas refrigerant. A part of the lubricating oil supplied to the compression chamber (14) is discharged from the discharge port (11*c*) of the movable scroll (11) in a state of being mixed with the compressed gas refrigerant.

A part of the lubricating oil which has not been supplied to the compression chamber (14) and has been left in the space (40), flows downward through the bearing (28) provided in the bearing hole (25*a*) of the partition wall (25) while lubricating the inner and outer peripheries of the bearing (28).

Around a part of the crank shaft (8) located between the partition wall (25) and the electric motor (7), there is provided a protect cover (32) which prevents a lubricating oil flowing downward from the bearing (28) from reaching the electric motor (7). The protect cover (32) is fixedly attached to the bottom of the partition wall (25) by a bolt (33). An oil backing pipe (34) for returning the lubricating oil to the oil reservoir (1*a*) is connected to a part of the side surface of the protect cover (32) located at the side of the balance weight (8*d*) of the crank shaft (8). The oil backing pipe (34) horizontally extends to the side wall of the casing (1) at a level above the electric motor (7), is bent downward at an approximately right angle, passes between the stator (7*a*) of the electric motor (7) and the side wall of the casing (1), and then reaches the oil reservoir (1*a*). The oil backing pipe (34) is supported to the side surface of the stator (7*a*). Accordingly, the lubricating oil flowing downward from the bearing (28) is returned to the oil reservoir (1*a*) through the oil backing pipe (34).

At the inside of the crank shaft (8), there is formed a discharge gas passage (8*e*) for causing the gas refrigerant discharged from the discharge port (11*c*) to flow on the side opposite to the scroll compression mechanism (3) with respect to the electric motor (7) of the discharge chamber (22), i.e., toward the oil reservoir (1*a*). The discharge gas passage (8*e*) is connected at the upstream end thereof to the through hole (24*a*) of the bushing (24). Hence, the sealing member (26) is provided between the discharge port (11*c*) of the movable scroll (11) and the opening at the upstream end of the discharge gas passage (8*e*). The discharge gas passage (8*e*) has a diameter larger than that of the supply passage (8*b*) and extends to the vicinity of the centrifugal supply pump (8*a*) in parallel with the supply passage (8*b*). The discharge gas passage (8*e*) is connected at the downstream end thereof to a discharge gas outlet (8*f*) open at the outer periphery of the crank shaft (8) so as to be communicated with a space between the electric motor (7) and the oil reservoir (1*a*). Thereby, the gas refrigerant discharged from the discharge port (11*c*) of the movable scroll (11) flows through the concavity (11*d*) for connection at the boss (11*e*) of the movable scroll (11), the through hole (26*a*) of the sealing member (26), the through hole (24*a*) of the bushing (24) and the discharge gas passage (8*e*) of the crank shaft (8) in order, and flows out of the discharge gas outlet (8*f*) to the discharge chamber (22).

In a space of the discharge chamber (22) located between the electric motor (7) and the gas outlet (8*f*) at the downstream end of the discharge gas passage (8*e*), a demister (37) as an oil separation mechanism is disposed around the crank shaft (8). The demister (37) is composed of a support member (37*a*) and a filter member (37*b*). The support member (37*a*) is composed of: upper and lower horizontal parts arranged vertically with the discharge gas outlet (8*f*) of the discharge gas passage (8*e*) interposed therebetween; and a vertical part which connects both the horizontal parts and is fixedly attached to the inner periphery of the side wall of the casing (1). The filter member (37*b*) is fixedly attached to the bottom of the upper horizontal part. The filter member (37*b*) is for fully separating a lubricating oil which has not been fully separated from the gas refrigerant in the discharge gas passage (8*e*) when the discharged gas refrigerant from the discharge gas outlet (8*f*) flows toward the electric motor (7).

In FIG. 1, referential numeral (20) indicates a terminal part for supplying electric power to the electric motor (7).

The operation of the scroll compressor (A) having the above structure is described below. First, the electric motor (7) is operated in a state that a power source is connected to the terminal part (20). When the motor (7) is operated, the rotor (7*b*) and the crank shaft (8) integrally rotate on the axis of the crank shaft (8) so that the sealing member (26) travels around the axis of the crank shaft (8). This is accompanied with a travel of the movable scroll (11) around the axis of the fixed scroll (10). Thereby, contact points on the peripheries of the volutes (10*b*), (11*b*) of both the scrolls (10), (11) shift toward the center of the scroll compression mechanism (3) so that the compression chamber (14) is decreased in volume while moving in a spiral from the outer peripheral part in a space between both the scrolls (10), (11) to the center. Through such a series of movements, a low-pressure gas refrigerant is sucked into the compression chamber (14) through the suction pipe (5) and the suction port (10*c*) of the fixed scroll (10), is compressed in the compression chamber (14) thereby turning high-pressure gas, and is then discharged from the discharge port (11*c*) of the movable scroll (11).

The lubricating oil in the oil reservoir (1*a*) is pumped, by the centrifugal supply pump (8*a*), to the bottom of the concavity (8*c*) of the crank shaft (8) through the supply passage (8*b*), flows through the bearing (29) between the boss (11*e*) of the movable scroll (11) and the concavity (8*c*) of the crank shaft (8) while lubricating the inner and outer peripheries of the bearing (29), and then reaches the space (40) between the upper end of the crank shaft (8) and the bottom of the end plate (11*a*) of the movable scroll (11). A part of the lubricating oil is supplied to the compression chamber (14) through the oil inlet (11*f*) formed in the end plate (11*a*) of the movable scroll (11) by a pressure difference between the inside and outside of the scroll compression mechanism (3) in the middle of compression of the gas refrigerant. This allows the lubricating oil to enter gaps located between each of the end surfaces of the volutes (10*b*), (11*b*) of the fixed and movable scrolls (10), (11) and each of the corresponding end plates (11*a*), (10*a*) of the scrolls (11), (10). Thereby, the gaps are filled with the lubricating oil so that the compression chamber (14) can be kept in a gastight condition.

The suction of the gas refrigerant into the scroll compression mechanism (3) is performed in such a way as to be sucked directly from the suction pipe (5) into the compression chamber (14). In addition, the scroll compression mechanism (3) is placed in the suction chamber (23). Accordingly, the sucked gas refrigerant can be prevented from being heated by a heat loss of the electric motor (7) in the discharge chamber (22). Further, since the high-pressure lubricating oil is supplied to the compression chamber (14) in the middle of compression of the gas refrigerant, the sucked gas refrigerant can be prevented from being heated from the lubricating oil. As a result, the performance of the compressor (A) can be increased. Also in the case that the gas refrigerant is not sucked directly from the suction pipe (5) into the compression chamber (14) but the gas refrigerant is first caused to flow into the suction chamber (23) and is then sucked from the suction chamber (23) into the compression chamber (14), the sucked gas refrigerant is prevented from being heated by a heat loss of the electric motor (7).

The remaining lubricating oil in the space (40), which has not been supplied to the compression chamber (14), flows downward through the bearing (28) between the bearing hole (25*a*) of the partition wall (25) and the crank shaft (8) while lubricating the inner and outer peripheries of the bearing (28), and is then returned to the oil reservoir (1*a*) through the oil backing pipe (34).

The high-pressure gas refrigerant discharged from the discharge port (11*c*) of the movable scroll (11) is mixed with the lubricating oil supplied to the compression chamber (14) and in this state, runs through the concavity (11*d*) for connection of the boss (11*e*) of the movable scroll (11), the through hole (26*a*) of the sealing member (26), the through hole (24*a*) of the bushing (24) and the discharge gas passage (8*e*) of the crank shaft (8) in order. Then, the gas refrigerant flows out of the discharge gas outlet (8*f*) of the discharge gas passage (8*e*) and reaches a space in the discharge chamber (22) located between the electric motor (7) and the oil reservoir (1*a*).

At this time, the sealing member (26) is pushed downward by the spring (27) to rotatively slide on the bushing (24) in a state that the bottom surface thereof contacts the top surface of the bushing (24). In addition, the sealing member (26) is fitted in the concavity (11*d*) for connection of the boss (11*e*) of the movable scroll (11). Accordingly, the gas refrigerant discharged from the discharge port (11*c*) is prevented from being mixed with the lubricating oil pumped up to the bottom of the concavity (8*c*) at the upper end of the crank shaft (8) through the supply passage (8*b*). As a result, the gas refrigerant is securely introduced into the discharge gas passage (8*e*) without the mixture with the lubricating oil.

Further, the gas refrigerant flows through the discharge gas passage (8*e*) of the crank shaft (8) in rotation so that the lubricating oil is separated from the gas refrigerant. The separated lubricating oil flows out of the discharge gas outlet (8*f*) of the discharge gas passage (8*e*) and drops into the oil reservoir (1*a*). On the other hand, the gas refrigerant runs through the filter member (37*b*) attached to the upper horizontal part of the support member (37*a*) of the demister (37), flows upward from a space around the electric motor (7) and is discharged to the outside of the compressor (A) through the discharge pipe (6). When the gas refrigerant runs through the filter member (37*b*) of the demister (37), the lubricating oil which has not been separated from the gas refrigerant in the discharge gas passage (8*e*) is fully separated. This prevents an oil discharge through the electric motor (7). Furthermore, since the gas refrigerant flows through the space around the electric motor (7), the electric motor (7) can be efficiently cooled. Moreover, since the lubricating oil separated from the gas refrigerant can be returned to the oil reservoir (1*a*) as it is, this eliminates the need for capillary or the like used when the lubricating oil is got from a high-pressure state back into a low-pressure state.

In the case that the electric motor (7) is configured to be variable in speed by an inverter or the like, the demister (37) displays an excellent effect, when a large amount of lubricating oil is supplied to the compression chamber (14) under high-speed rotation of the electric motor (7) and is mixed with the discharged gas so that the lubricating oil cannot be fully separated from the refrigerant gas in the discharge gas passage (8*e*) of the crank shaft (8). Therefore, in the case that the electric motor (7) is not variable in speed so as not to rotate at a high speed, the lubricating oil can be substantially fully separated in the discharge gas passage (8*e*) of the crank shaft (8) without such a demister (37), which prevents an oil discharge through the electric motor (7). On the other hand, in the first-mentioned case that the demister (37) is provided, it can be placed in a large space between the electric motor (7) and the oil reservoir (1*a*), which increases an oil separation efficiency thereby securely preventing an oil discharge through the drive means.

As mentioned so far, in the present embodiment, the electric motor (7) and the oil reservoir (1*a*) are placed in the discharge chamber (22), the gas refrigerant compressed in the compression chamber (14) of the scroll compression mechanism (3) is discharged from the movable scroll (11) and is caused to flow through the discharge gas passage (8*e*) of the crank shaft (8) for driving the movable scroll (11), and the lubricating oil is separated, in the discharge gas passage (8*e*), from the gas refrigerant. Accordingly, increase in temperature of the sucked gas refrigerant can be prevented and the lubricating oil can be efficiently separated from the gas refrigerant thereby preventing an oil discharge through the electric motor (7). As a result, the performance of the compressor (A) can be increased and the lubricating oil can be readily separated from the gas refrigerant at a low cost.

INDUSTRIAL APPLICABILITY

When the gas-tightness of a compression chamber in a scroll compressor is increased by oil supply or when a bearing for a crank shaft for power-transmittablly connecting a movable scroll of a compression mechanism with a motor for driving is lubricated by oil, the present invention prevents a sucked gas from being heated by a heat loss caused in the motor or by the oil thereby increasing a compressor performance, and eliminates a special member for separating the oil from a compressed gas thereby accomplishing cost reduction of the compressor. In this point, the present invention has a high industrial applicability.

What is claimed is:

1. A scroll compressor comprising:

a partition wall (25) which is disposed in a sealed casing (1) and divides an inner space of the sealed casing (1) into a discharge chamber (22) and a suction chamber (23);

a scroll compression mechanism (3) which is composed of a fixed scroll (10) and a movable scroll (11) each disposed in the casing (1), said fixed scroll (10) being composed of an end plate (10*a*) and a volute (10*b*) projecting from the end plate (10*a*), said movable scroll (11) being composed of an end plate (11*a*) and a volute (11*b*) which projects from the end plate (11*a*) and is engage with the volute (10*b*) of the fixed scroll (10) to divide a compression chamber (14) into sections, said scroll compression mechanism (3) compressing in the compression chamber (14) a gas sucked from the outer peripheries ofthe volutes (10*b*), (11*b*) of both the scrolls (10), (11) through the travel ofthe movable scroll (11) around the axis of the fixed scroll (10) and then discharging the gas to the discharge chamber (22);

drive means (7) for driving the movable scroll (11) through a crank shaft (8) into travel around the axis of the fixed scroll (10); and a supply pump (8*a*) for sucking an oil of an oil reservoir (1*a*) in the casing (1) and supplying the sucked oil to a bearing (28), (29) for the crank shaft (8) through a supply passage (8*b*) provided in the crank shaft (8), wherein the drive means (7) and the oil reservoir (1*a*) are placed in the discharge chamber (22), a discharge port (11*c*) for discharging the gas compressed in the compression chamber (14) is formed in the end plate (11*a*) of the movable scroll (11), the crank shaft (8) is provided at the inside thereof with a discharg gas passage (8*e*) for causing the gas discharged through the discharge port (11*c*) of the movable scroll (11) to flow into the discharge chamber (22), and an oil separation mechanism (37) is placed in the discharge chamber (22) between the drive means (7) and the opening at the downstream end of the discharge gas passage (8*e*)

wherein the downstream end of the discharge gas passage (8*e*) in the crank shaft (8) is formed into an opening on the side opposite to the scroll compression mechanism (3) with respect to the drive means (7) and a discharge pipe (6) for discharging the discharge gas flowing into the discharge chamber (22) through the discharge gas passage (8*e*) to the outside of the casing (1) is placed on the same side as the scroll compression mechanism (3) with respect to the drive means (7).

2. A scroll compressor according to claim 1, wherein a sealing member (26) for keeping the gas discharged through the discharge port (11*c*) of the movable scroll (11) away from the oil pumped through the supply passage (8*b*) by the supply pump (8*a*) is provided between the discharge port (11*c*) and an opening at the upstream end of the discharge gas passage (8*e*).

3. A scroll compressor comprising:

a partition wall (25) which is disposed in a sealed casing (1) and divides an inner space of the sealed casing (1) into a discharge chamber (22) and a suction chamber (23);

a scroll compression mechanism (3) which is composed of a fixed scroll (10) and a movable scroll (11) each disposed in the casing (1), said fixed scroll (10) being composed of an end plate (10*a*) and a volute (10*b*) projecting from the end plate (10*a*), said movable scroll (11) being composed of an end plate (11*a*) and a volute (11*b*) which projects from the end plate (11*a*) and is engaged with the volute (10*b*) of the fixed scroll (10) to divided a compression chamber (14) into sections, said scroll compression mechanism (3) compressing in the compression chamber (14) a gas sucked from the outer peripheries ofthe volutes (10*b*), (11*b*) of both the scrolls (10), (11) through the travel of the movable scroll (11) around the axis of the fixed scroll (10) and then discharging the gas to the discharge chamber (22);

drive means (7) for driving the movable scroll (11) through a crank shaft (8) into travel around the axis of the fixed scroll (10); and a supply pump (8*a*) for sucking an oil of an oil reservoir (1*a*) in the casing (1) and supplying the sucked oil to a bearing (28), (29) for the crank shaft (8) through a supply passage (8*b*) provided in the crank shaft (8), wherein the drive means (7) and the oil reservoir (1*a*) are placed in the discharge chamber (22), a discharge port (11*c*) for discharging the gas compressed in the compression chamber (14) is formed in the end plate (11*a*) of the movable scroll (11), the crank shaft (8) is provided at the inside thereof with a discharge gas passage (8*e*) for causing the gas discharged through the discharge port (11*c*) of the movable scroll (11) to flow into the discharge chamber (22), the scroll compression mechanism (3) is placed in the suction chamber (23), and an oil separation mechanism (37) is placed in the discharge chamber (22) between the drive means (7) and the opening at the downstream end of the discharge gas passage (8*e*)

wherein the downstream end of the discharge gas passage (8*e*) in the crank shaft (8) is formed into an opening on the side opposite to the scroll compression mechanism (3) with respect to the drive means (7) and a discharge pipe (6) for discharging the discharge gas flowing into the discharge chamber (22) through the discharge gas passage (8*e*) to the outside of the casing (1) is placed on the same side as the scroll compression mechanism (3) with respect to the drive means (7).

4. A scroll compressor according to claim 3, wherein a sealing member (26) for keeping the as discharged through the discharge port (11*c*) of the movable scroll (11) away from the oil pumped through the supply passage (8*b*) by the supply pump (8*a*) is provided between the discharge port (11*c*) and an opening at the upstream end of the discharge gas passage (8*e*).

* * * * *

UNITED STATES PATENT AND TRADEMARK OFFICE

CERTIFICATE OF CORRECTION

PATENT NO. : 6,135,738

DATED : October 24, 2000

INVENTOR(S) : Mikio KAJIWARA, Yoshitaka SHIBAMOTO and Keiji YOSHIMURA

It is certified that error appears in the above-identified patent and that said Letters Patent is hereby corrected as shown below:

On the Cover Page:

In the Title, section [54], change "moveable" to -- movable --;

In the Abstract, section [57], line 11, change "flowinto" to -- flow into --.

In the Claims:

in claim 1, column 10, line 27, after "peripheries" change "ofthe" to -- of the -- and in line 44, change "discharg" to – discharge --;

in claim 3, column 11, line 17, after "peripheries" change "ofthe" to -- of the --.

Signed and Sealed this

Eighth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,135,738
DATED : October 24, 2000
INVENTOR(S) : Mikio Kajiwara et al.

It is certified that error appears in the above-identified patent and that said Letters Patent is hereby corrected as shown below:

Column 12,
Line 24, change "as" to -- gas --.

Signed and Sealed this

Seventh Day of May, 2002

*Attest:*

*Attesting Officer*

JAMES E. ROGAN
*Director of the United States Patent and Trademark Office*